US010047709B2

(12) United States Patent
Rodier et al.

(10) Patent No.: US 10,047,709 B2
(45) Date of Patent: Aug. 14, 2018

(54) FUEL INJECTOR FOR AN INTERNAL COMBUSTION ENGINE

(71) Applicant: DELPHI TECHNOLOGIES IP LIMITED, St. Michael (BB)

(72) Inventors: Nicolas Rodier, Blois (FR); Quentin Roussot, Blois (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/324,525

(22) PCT Filed: Jun. 23, 2015

(86) PCT No.: PCT/EP2015/064075
§ 371 (c)(1),
(2) Date: Jan. 6, 2017

(87) PCT Pub. No.: WO2016/005180
PCT Pub. Date: Jan. 14, 2016

(65) Prior Publication Data

US 2017/0152822 A1 Jun. 1, 2017

(30) Foreign Application Priority Data

Jul. 8, 2014 (GB) ..... 1412086.9

(51) Int. Cl.
*F02M 47/02* (2006.01)
*F02M 47/00* (2006.01)

(52) U.S. Cl.
CPC ..... *F02M 47/02* (2013.01); *F02M 47/027* (2013.01); *F02M 2200/28* (2013.01)

(58) Field of Classification Search
CPC ... F02M 47/02; F02M 47/027; F02M 2200/28
USPC ..... 123/445
See application file for complete search history.

(56) References Cited

U.S. PATENT DOCUMENTS

| | | | | |
|---|---|---|---|---|
| 6,371,084 | B1 | 4/2002 | Betz | |
| 6,698,666 | B2 * | 3/2004 | Ohata | F02M 47/027 239/533.5 |
| 2003/0025004 | A1 * | 2/2003 | Aoki | F02M 47/027 239/533.2 |

FOREIGN PATENT DOCUMENTS

| | | | |
|---|---|---|---|
| DE | 102008041561 | A1 | 3/2010 |
| EP | 1281858 | A2 | 2/2003 |
| EP | 1296055 | A2 | 3/2003 |
| EP | 1795738 | A1 | 6/2007 |

(Continued)

*Primary Examiner* — Mahmoud Gimie
(74) *Attorney, Agent, or Firm* — Joshua M. Haines

(57) ABSTRACT

A fuel injector includes a nozzle body having a spray tip with at least one spray orifice and a needle slideably arranged in the nozzle body in order to control the spray orifice. A control chamber is associated with the needle, which is filled with high-pressure fuel in order to exert a pressure force on the needle in its closing direction; the control chamber being in communication with a high pressure fuel channel through an inlet restrictor and with a low pressure drain through an outlet restrictor via a control valve to selectively allow or hinder the flow of fuel out of the control chamber through the outlet restrictor. The inlet restrictor and outlet restrictor are designed so that the ratio of outlet fuel flow rate over inlet fuel flow rate increases at low fuel temperatures, in order to cause a greater pressure reduction in the control chamber.

20 Claims, 4 Drawing Sheets

(56) References Cited

FOREIGN PATENT DOCUMENTS

| | | | |
|---|---|---|---|
| GB | 2336627 | A | 10/1999 |
| JP | 2003269286 | A | 9/2003 |
| JP | 2011174390 | A | 9/2011 |
| JP | 2011190746 | A | 9/2011 |
| WO | 2015078629 | A1 | 6/2015 |

* cited by examiner

FUEL INJECTOR FOR AN INTERNAL COMBUSTION ENGINE

CROSS REFERENCE TO RELATED APPLICATIONS

This application is a national stage application under 35 USC 371 of PCT Application No. PCT/EP2015/064075 having an international filing date of Jun. 23, 2015, which is designated in the United States and which claimed the benefit of GB Patent Application No. 1412086.9 filed on Jul. 8, 2014 the entire disclosures of each are hereby incorporated by reference in their entirety.

FIELD OF THE INVENTION

The present invention generally relates to the field of internal combustion engines and more specifically to a fuel injector for such engine, in particular for a diesel engine.

BACKGROUND OF THE INVENTION

As it is well known in the art, a fuel injection system of an internal combustion engines typically includes a plurality of fuel injectors, each of which is arranged to inject fuel into the combustion chamber of an associated engine cylinder. Each fuel injector is supplied with high-pressure fuel from a suitable source, such as a common rail, which is charged with fuel at high pressure by a high-pressure fuel pump.

A fuel injector generally comprises a nozzle body, which houses an elongate valve needle. The nozzle body has a spray tip with one or more spray orifices, and, in use, the injector is mounted so that its spray tip protrudes into the associated combustion chamber, whereby fuel can be injected into the combustion chamber at high pressure in the form of an atomised spray. Fuel supplied from a high-pressure fuel channel accumulates in the nozzle body, surrounding the needle, ready for delivery to the spray orifices when required for injection.

The longitudinal displacement of the needle is controlled by means of a solenoid-actuated control valve arrangement, which controls the pressuring or discharging of a control chamber located above the valve needle. For example, the end of the needle opposite the tip is received within the control chamber and is thus subject to the fuel pressure therein, causing a pressure force in the closing direction. In addition, a spring mounted e.g. in the closing chamber conventionally biases the needle in the closing direction.

The control chamber is supplied with fuel from the high-pressure fuel channel through an inlet restrictor, which defines an inlet flow rate. Fuel can exit the control chamber through an outlet channel leading to the control valve and further downstream to a low-pressure drain, when the control valve is open. An outlet restrictor is provided at the entry of the outlet channel to control the flow rate of fuel exiting the control chamber. In order to open the injector, the solenoid actuator of the control valve arrangement is energized to move its valve member and hence open the flow path towards the low-pressure drain, causing a pressure drop in the control chamber. Injection occurs when the pressure acting on the needle spray region exceeds the force exerted on the needle by the fuel in the control chamber and the spring force, causing the needle to lift.

Such fuel injector is, e.g., disclosed in EP 2 647 826.

Fuel injectors of the above-described type have shown to generally operate in a satisfactory manner. However, it has been observed that the injector performances are altered at low temperatures, e.g. when starting a cold engine under cold climate conditions, say below 0° C. This appears to be mostly due to the fact that at low temperatures, the viscosity of the fuel increases substantially, causing difficulties for opening the nozzle and thus deficiency on the injector delivery rate.

OBJECT OF THE INVENTION

The object of the present invention is to provide an improved fuel injector that has improved behaviour at low temperatures.

SUMMARY OF THE INVENTION

A fuel injector for an internal combustion engine in accordance with the present invention comprises:

a nozzle body having a spray tip through which fuel can be selectively emitted through at least one spray orifice;

a needle slideably arranged in the nozzle body in order to control the at least one spray orifice through its displacement; and a control chamber associated with the needle, which, in use, is filled with high-pressure fuel in order to exert, at least indirectly, a pressure force on the needle in its closing direction.

The control chamber is in communication with a high-pressure fuel channel through an inlet restrictor orifice and the pressure in the chamber can be selectively reduced by allowing fuel to flow out of the chamber through an outlet restrictor orifice. A control valve is operated by an actuator and associated with the control chamber to allow or hinder the flow of fuel out of the control chamber through the outlet restrictor.

It shall be appreciated that the inlet restrictor orifice and the outlet restrictor orifice have respective geometries that are designed so that the ratio of outlet fuel flow rate over inlet fuel flow rate increases at low fuel temperatures, as compared to normal fuel temperatures at same fuel pressure, in order to cause a greater pressure reduction in the control chamber, and thereby facilitate the nozzle opening.

It may be noted that under conventional injector design considerations, the pressure drop in the control chamber is traditionally defined by playing on the diameters of the inlet and outlet restrictor orifices, in order to create a predetermined leakage rate out of the control chamber at normal injector operating conditions ("normal" here generally designates a fuel temperature of at least 40° C., in particular as measured at the entry of the high-pressure fuel pump of the injection system).

By contrast, the present invention advantageously proposes acting on the shape factor of the restrictor orifices, in particular on their diameter and length, in order to modify the leakage flow rate at low temperatures (i.e. for fuel at temperatures lower than 0° C. in the fuel system, in particular as measured at the entry of the high-pressure fuel pump) without sensibly affecting the injector's performance at normal temperatures.

In this context, it is a particular merit of the present inventors to have observed that acting on the length of the inlet or outlet restrictor orifice permits amending the flow rates at low temperatures to or from the control chamber, without modifying the leakage rate from the control chamber under normal operating conditions. In practice, the desired flow behaviour can be achieved through the following design options. Preferably, the configuration of the inlet and outlet restrictor orifices is such as that the dimensional ratio $R_{dim}$ defined as $$R\text{dim}=(L_{SPO}/D_{SPO})/(L_{INO}/D_{INO}),$$

is not more than 0.75, where $L_{SPO}$ and $D_{SPO}$ are the respective length and diameter of the outlet restrictor orifice, and $L_{INO}$ and $D_{INO}$ are the respective length and diameter of the inlet restrictor orifice.

In particular, $R_{dim}$ is preferably in the range $0.1 \leq R_{dim} \leq 0.70$, more preferably in the range $0.1 \leq R_{dim} \leq 0.5$, and even more preferably in the range $0.2 \leq R_{dim} \leq 0.4$.

In one embodiment, the inlet and outlet restrictor orifices have diameters differing by 10 to 20%, i.e. their diameter ratio $R_D$ is in the range: $0.8 \leq R_D \leq 1.2$, preferably $0.9 \leq R_D \leq 1.1$. In such case, the desired flow behaviour in the control chamber at low temperatures can be obtained by a configuration of the inlet and outlet restrictor orifices such that the length ratio $R_L = L_{SPO}/L_{INO}$ is in the range $0.2 \leq R_L \leq 0.8$.

In practice, the restrictor orifices, in particular the inlet restrictor orifice, may simply be a machined bore. In another embodiment, the inlet orifice can be formed by an axial groove in the outer surface of a plug element fitted in a fuel channel leading to the control chamber.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
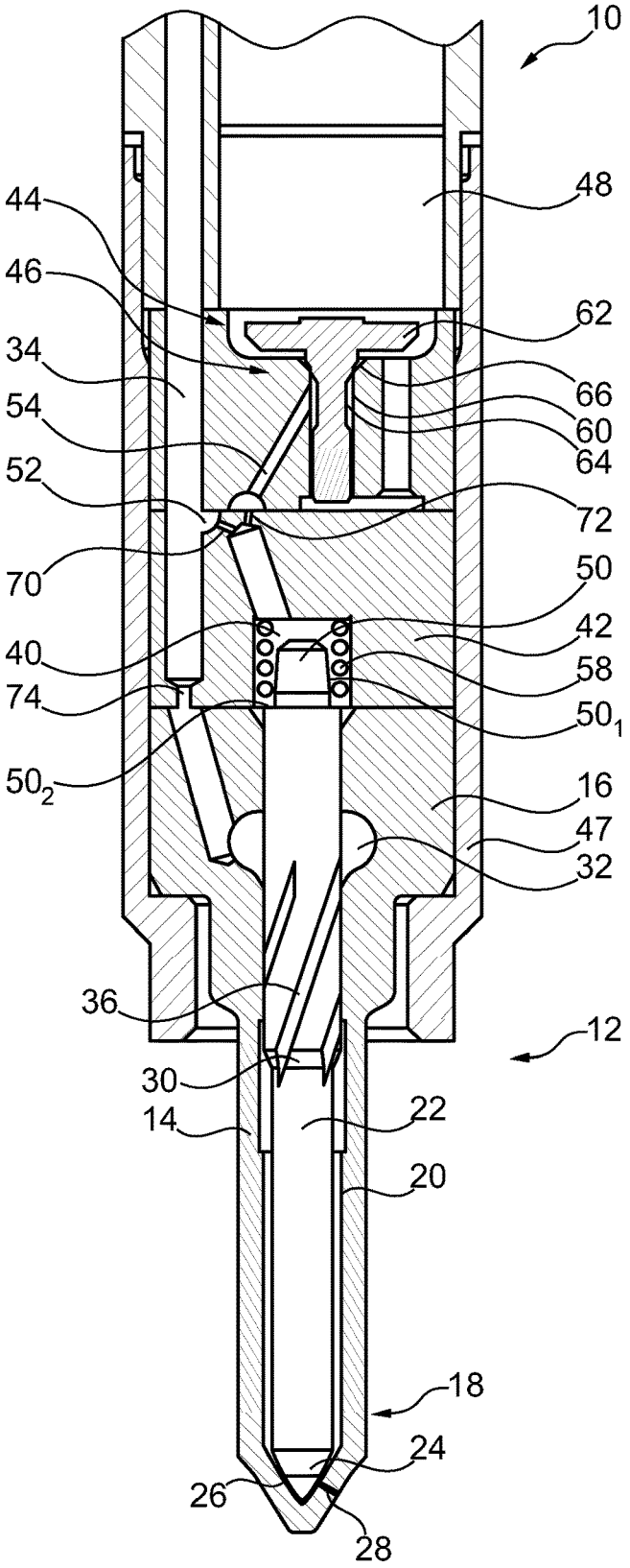
FIG. 1: is a longitudinal section view through one embodiment of the present fuel injector, in closed configuration.
Figure 8:
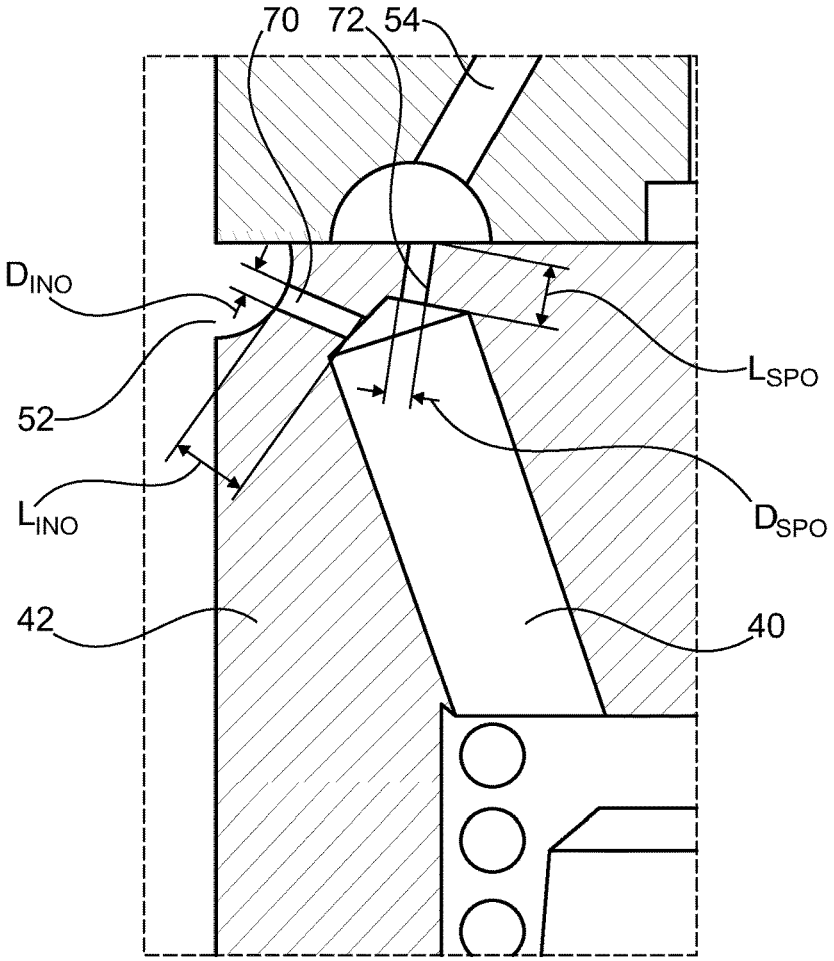
FIG. 8: is a detail of FIG. 1 showing the inlet and outlet orifices in an enlarged view.

Referring to FIG. 1, there is presented one embodiment of the present fuel injector 10 for an internal combustion engine, in particular a diesel ICE.

Reference sign 12 generally indicates a nozzle arrangement comprising a nozzle body 14 that includes a top 16 and a spray tip 18 region and is provided with a bore 20, which extends through both the top and spray tip regions, the bore terminating at a position spaced from the free end of the spray tip region. An elongate needle 22 is slidable within the bore 20, the needle including a tip region 24, which is arranged to engage a valve seat 26 defined by the inner surface of the nozzle body adjacent the blind end of the bore. The nozzle body 14 is provided with one or more spray orifices 28 (only one is shown) communicating with the bore 20, the spray orifices 28 being positioned such that the engagement of the tip 24 of the needle 22 with the valve seat 26 prevents fluid escaping from the nozzle body 14 through the spray orifices 28, and when the needle tip 24 is lifted from the valve seat 26, fuel may be delivered through the spray orifices 28.

As shown in FIG. 1, the needle 22 may be conventionally shaped such that the region thereof, which extends within the spray tip region 18 of the nozzle body 14, is of smaller diameter than the bore to permit fluid to flow between the needle and the inner surface of the nozzle body. Within the top region 16 of the nozzle body, the needle 22 is of larger diameter, substantially preventing fluid flowing between the needle and the nozzle body. The region between the top and spray tip region comprises a chamfer between the difference diameters of the two mentioned regions and thus provide angled pressure surfaces 30 on which high-pressure fuel can be applied.

In the present design, the top region of the nozzle body 14 is provided with an accumulator volume 32, which communicates with a high-pressure fuel channel 34 that extends along the injector 10, from the upper region (not shown) where fuel enters e.g. from a common rail of the engine injection system, down to the nozzle body 14. In order to permit fuel to flow from the accumulator volume 32 to the spray tip region 18 of the nozzle body, the needle 22 is preferably provided with a fluted region 36, which permits fuel to flow from the accumulator volume 32 to the spray tip region 18 of the nozzle body. This needle region is also tightly received in the bore and thereby acts to restrict lateral movement of the needle within the nozzle body but not restricting axial movement thereof.

A control chamber 40, filled with pressurized fuel, is associated with the needle 22 to exert a controlled pressure force on the needle in its closing direction. The control chamber 40 is located above the needle 22 and located in a so-called spacer component 42, situated directly above the nozzle arrangement. The control chamber 40 itself is associated with a control valve arrangement 44 comprising a control valve 46 operated by an actuator (not show), which allows controlling the fuel pressure in the control chamber 40 as will be explained below. Classically, the various body parts 16, 42, 44 etc. are held together in a casing 47.

The top end 50 of the needle 22, remote from the tip 24 thereof, protrudes into the control chamber 40 and closes the latter towards the nozzle arrangement. The control chamber 40 is in fluid communication with the high-pressure fuel channel 34 through an inlet channel 52 for the supply of fuel. Reference sign 54 indicates an outlet channel through which fuel can flow out of the control chamber 40 to the control valve 44, and further downstream to a low-pressure drainage (not shown). The needle 22 is typically associated with spring means in order to bias it in closing direction. Here, the spring 58 is located in the control chamber 40 and engages the top end 50 of the needle, in particular by surrounding a reduced diameter projection $\mathbf{50}_1$ and resting on a circumferential shoulder $\mathbf{50}_2$, as seen in FIG. 1.

The control valve arrangement 44, located above the spacer component 42, comprises a valve body having a central bore 60 in which a valve member 62 is slidable. The valve member 62 carries a number of axial grooves 64 of which one is a sealing face, which is engageable with a seat 66 at an end of the bore 60. When the sealing face is brought into contact with the seat 66, a contact making pressure seal is made. When the valve member 62 is lifted from its seat, fuel can flow therethough to the downstream low-pressure drainage section. Hence, control valve 44 permits controlling (i.e. permitting or hindering) the communication between the control chamber 40 and the low-pressure drain section.

Preferably, a valve spring (not shown) is located above the control valve 46 and acts to urge the sealing face of the valve member 62 into engagement with the seat 66 in the bore in the valve arrangement body. The actuator (not shown), preferably of the solenoid type, is typically located above the control valve (e.g. in chamber 48) to operate the valve member 62. At an energization of the solenoid actuator, the valve member 62 is lifted such that the valve member 62 disengages its sealing face from the seat in the bore of the valve arrangement body. On de-energizing the solenoid actuator, the valve member returns to its original position under the action of the valve spring.

As it is known in the art, the fuel injector operation, namely opening and closing thereof, is achieved by controlling the hydraulic pressure acting on the needle 22. Therefore, the present fuel injector 10 conventionally comprises three restrictor orifices to provide controlled flow rates at selected locations:

- an inlet restrictor orifice 70, also known as inlet orifice (INO), is arranged on the flow of fuel from the high pressure channel 34 to the control chamber 40;
- an outlet restrictor orifice 72, also known as spill orifice (SPO), is arranged to restrict the flow of fuel out of the control chamber towards control valve 46; and
- a nozzle restrictor orifice 74, also known as nozzle path orifice (NPO), is arranged in the high pressure channel upstream of the needle front portion.

As it is known in the art, the inlet 70 and outlet 72 restrictors cooperate to define, when control valve 46 is open, a fuel leakage rate of the control chamber 40 in order to create a pressure drop therein allowing the opening of the needle 22. The nozzle restrictor 74, in turn, allows reducing the high-pressure acting on the needle surfaces downstream thereof, in particular for the purpose of closing the nozzle.

Such internal fuel injector construction, in particular regarding the control chamber, the control valve, the restrictors INO, SPO and NPO, as well as the control of hydraulic forces acting on the nozzle in the nozzle body and in the control chamber are known in the art, e.g. from EP 2 647 826. As it will be clear to those skilled in the art, other body designs departing from the 3-part structure shown herein can be envisaged, for example where the spacer component is integrated in the control valve arrangement, and the control chamber is embodied in the nozzle arrangement.

In use, in the position shown in FIG. 1, the needle 22 is biased in the closing direction by the spring and by the high fuel pressure in the control chamber 40, such that the needle tip 24 engages the valve seat 26 and delivery of fuel from the fuel injector does not occur. These biasing forces are greater than the hydraulic forces acting on the needle 22 in the nozzle body 14.

In order to lift the tip of the needle 22 away from the valve seat 26 to permit fuel to be delivered from the fuel injector, the solenoid actuator is energized to lift the valve member 62 against the action of its valve spring such that the sealing face is lifted away from the seat in the bore 60 of the valve arrangement body. Such lifting of the control valve permits fuel to escape from the control chamber 40 through the outlet channel 54 and to drain through the bore 60 of the valve arrangement body, hence causing a pressure reduction in the control chamber 40. The needle will then lift from its seat when the fuel force (i.e. the force due to fuel pressure) on the needle front section within the bore 20 becomes greater than the fuel force in the control chamber 40 and the spring force.

In order to terminate delivery, the solenoid actuator is de-energized and the valve member 62 moves downwards under the action of its valve spring until the end thereof engages the sealing face against the seat 66 at the end of the bore in the valve arrangement body. Such movement of the control valve breaks the communication between the outlet channel 54 and the drain, hence causing the pressure within the control chamber to build up again to the level of the high pressure channel and pushing the needle 22 in its closing position.

As it will be understood, the inlet restrictor INO and outlet restrictor SPO are conventionally designed so as to form orifices defining predetermined flow rates so that in normal operation of the engine, typically fuel temperatures greater than 40° C. as measured at the entry of the high pressure fuel pump, a desired pressure drop can be created in the control chamber 40 to open the needle.

It has however been observed that at low temperatures, typically when starting the engine under cold environmental conditions (below 0° C. air temperature), the fuel temperature is quite low and the high viscosity of the fuel at such low temperatures affects (decreases) the pressure drop at the control chamber, whereby the needle stroke and lifting speed are lower than in nominal operating conditions. This phenomenon has as an overall negative impact on the injector delivery.

By contrast to conventional fuel injectors, in the present fuel injector the respective geometries of the inlet restrictor INO 70 and outlet restrictor SPO 72 are designed so that the ratio of outlet fuel flow rate over inlet fuel flow rate increases at low fuel temperatures, as compared to normal fuel temperatures at same fuel pressure, in order to cause a greater pressure reduction in the control chamber 40, at such low fuel temperatures, and thereby improve the needle opening behaviour.

As indicated before, the present design is developed for addressing situations of low fuel temperatures, typically fuel temperature below 0° C. and is put in contrast with conventional situations of normal fuel temperature, i.e. typically fuel temperature above 40° C., the fuel temperature being the temperature in the fuel system and in particular at the entry of the high pressure fuel pump.

This is advantageously achieved by selecting an appropriate shape factor of the restrictor orifices 70 and 72. It may be noticed that, in practice, restrictor orifices are formed as narrow diameter sections in the inlet and outlet channels (or at an end thereof), which may have a diameter in the range of 100 to 300 μm. While such restrictor orifices are generally designed as cylindrical orifices, and therefore are considered to have a diameter D and a length L, the manufacturing process may result in slight deviations from the nominal dimensions. Hence in practice, considering the manufacturing tolerances, the restrictor orifice may locally be slightly oval or conical, or similar. In case of such variations, the restrictor diameter D to be considered is the minimum cross-section offered by the restrictor. Where the cross-section is not strictly circular, the restrictor diameter D shall be the equivalent diameter.

Preferably, a restrictor orifice shape factor is herein characterized by its ratio $R_F$=L/D.

In order to provide a limited flow at low temperatures, it is desirable that the shape ratio of both restrictors, noted $$R_{dim}=R_{F_SPO}/R_{F_INO}$$

is less than 0.75, and preferably $0.1 \leq R_{dim} \leq 0.7$. More preferred ranges are $0.1 \leq R_{dim} \leq 0.5$ and $0.2 \leq R_{dim} \leq 0.4$.

In the present embodiment, the INO restrictor 70 is configured to provide an enhanced flow limitation at low temperatures as compared to conventional designs, by increasing the length LINO of the inlet restrictor 70.

It may be noted that at the injector design stage, the designer conventionally plays on the diameters of the INO and SPO, which are defined to achieve a predetermined flow ratio though the control chamber at normal/high operating temperatures.

In the context of the present invention, it has been observed that acting on the restrictor orifice's length LINO allows controlling the flow rate at low temperatures without affecting the design flow rate at normal/high temperatures. The present injector design is specifically meant for diesel fuel injectors operating at a fuel pressure in the range of 70 to 3000 bars, and the invention is of particular interest at cold engine, i.e. for fuel pressures typically not exceeding 500 bars.

It may be noted here that when the INO and SPO restrictor diameters are relatively similar, (say when they vary from about 10 to 20%) the difference between the INO and SPO can simply be characterized by the length ratio $R_L=L_{SPO}o/L_{INO}$, is should be in the range $0.2 \leq R_L \leq 0.8$ to provide the desired flow behaviour.

A few remarks on the manufacturing of the inlet and outlet restrictor orifices remain to be made. As indicated above, depending on manufacturing technique and tolerances, their shape may vary from a strict cylinder. They can be placed directly at the entry/exit of the control chamber, of within a channel leading to, respectively leaving, the control chamber, the important aspect being that the restrictor provide a flow restricting effect on the flow of fuel to or from the control chamber.

In the embodiment shown in FIG. 1, the inlet and outlet channels are typically machined in the body of the spacer.

Figure 2:
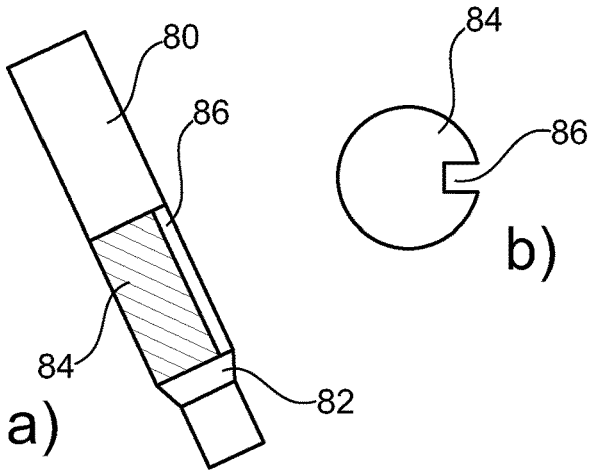
FIG. 2: is a sketch of an alternative way of manufacturing the inlet restrictor orifice in an inlet channel of a control chamber, showing a) a longitudinal section through a fuel channel with plug member therein and b) a top view of the plug.

Alternatively, a restrictor orifice can be formed as schematically shown in FIG. 2. Reference sign 80 indicates a channel that communicates e.g. from the high-pressure channel to the control chamber. Channel 80 is of cylindrical shape and ends with a tapering section 82. A plug 84 shaped as rod member having a diameter substantially matching the diameter of channel 80 has been inserted therein. Plug 84 is provided with a longitudinal/axial groove 86 on its outer surface that defines a flow channel, which is closed by the wall of the channel 80. Hence, plug 84 is a restrictor device defining a restrictor orifice (i.e. channel 86) of desired cross-section and length, by way of which a desired L/D factor can be achieved for the inlet or outlet restrictor.

EXAMPLE

An example of the efficiency of the present injector will now be given in the following.

In Table 1, summarizes the dimensional properties of the inlet and outlet orifices of two injectors according to the present design, noted A and B. Injector Z is a comparative example with a $R_{dim}$ not falling in the above prescribed range.

All three injectors have otherwise the same configuration. Since the dimensions of the outlet orifices are the same, and $D_{INO}$ substantially similar, the only sensibly varying parameter is thus $L_{INO}$.

TABLE 1

| Injector | A | B | Z |
|---|---|---|---|
| $L_{INO}$ | 2.50 mm | 1.20 mm | 0.7 mm |
| $D_{INO}$ | 0.2622 mm | 0.257 mm | 0.256 mm |
| $L_{SPO}$ | 0.7 mm | 0.7 mm | 0.7 mm |
| $D_{SPO}$ | 0.221 mm | 0.221 mm | 0.221 mm |
| $R_{dim}$ | 0.33 | 0.68 | 1.16 |

Figure 3:
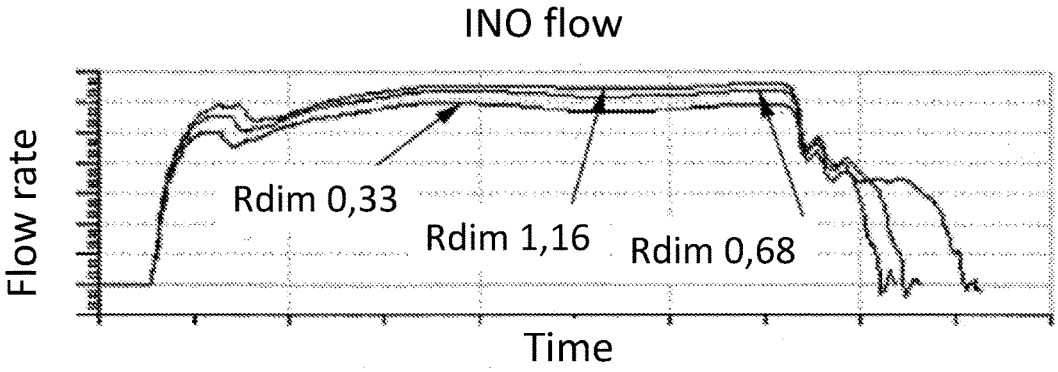
FIGS. 3 to 7: are graphs showing various injector characteristics for different values of dimensional ratio $R_{dim}$.
Figure 4:
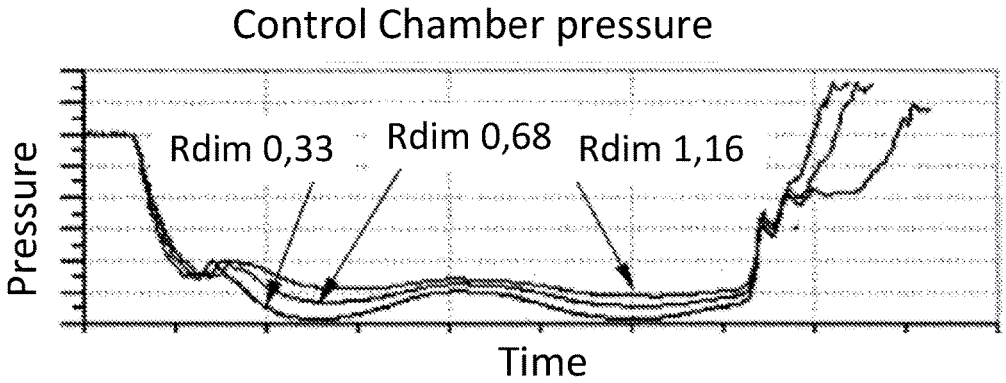
Figure 5:
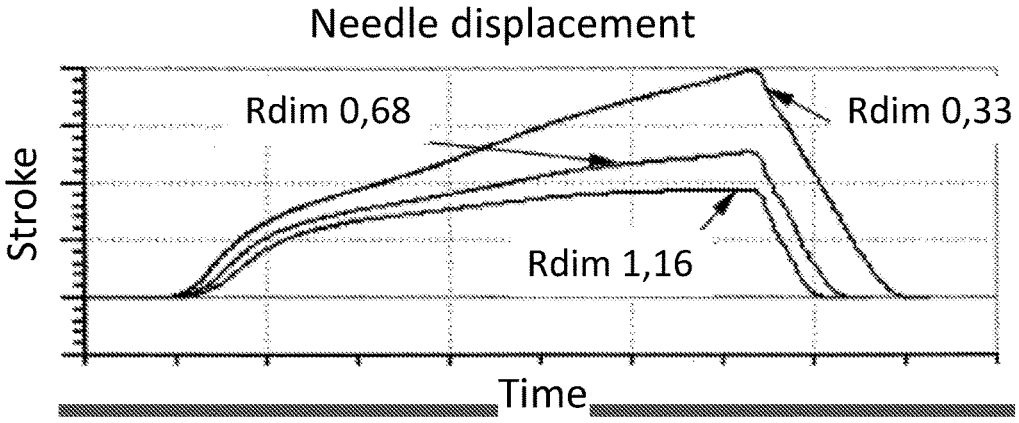
Figure 6:
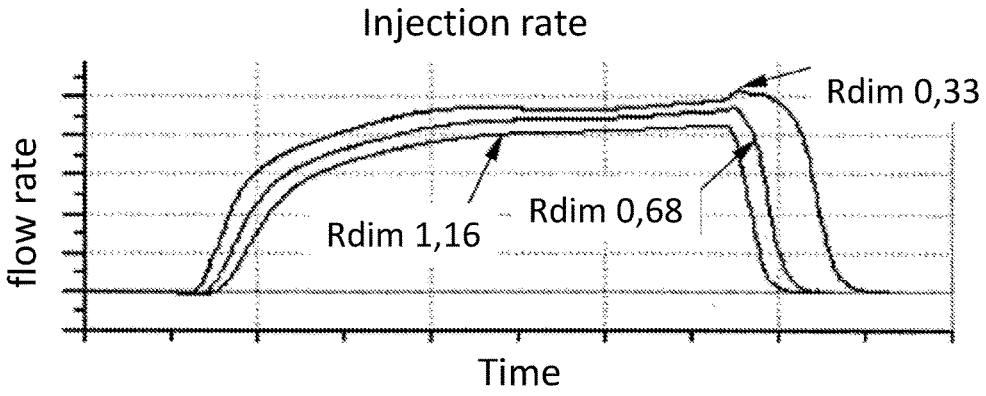

FIGS. 3 to 7 illustrate some performances of injectors A, B and Z. FIGS. 3 to 6 correspond to the following test conditions: −20° C., 3500 μs pulse and 300 b rail pressure. Turning first to FIG. 3, a reduction in the flow rate through the inlet opening INO with decreasing $R_{dim}$ can be clearly observed. Injector A with $R_{dim}$=0.33 having a sensibly reduced INO flow rate into the control chamber, as compared to injector Z. The consequence of the reduced INO flow rate obtained by a reduced $R_{dim}$ can be observed in the other graphs. FIG. 4 shows that the slowed down INO flow enhances the pressure drop in the control chamber. This increased pressure drop in the control chamber leads to a needle displacement (FIG. 5) that starts earlier and has a greater magnitude (stroke) as well as an increased opening speed. As can be seen, with an $R_{dim}$ of 0.33, the needle stroke is about twice the stroke measured for $R_{dim}$=1.16. This strikingly improvement in needle lift, in particular at $R_{dim}$=0.33, results in an increased injector flow rate, as evidenced by FIG. 6.

Figure 7:
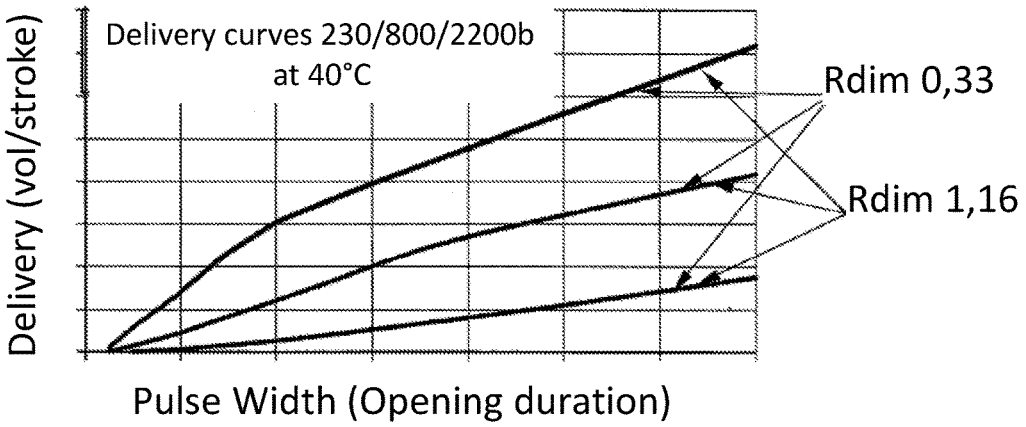

Finally, FIG. 7 shows the delivery curves (volume of fuel delivered by stroke) for three different Rail pressures at a temperature of 40° C., for injectors A and Z. As can be seen, the delivery curves for injectors A and Z are substantially similar.

The present test results hence show that acting on $R_{dim}$ (to meet the prescribed range) is very advantageous in that it allows a significant improvement of injector performance at low temperatures, without altering the injector's flow performance under normal operating conditions (i.e. 40° C. and higher).

The invention claimed is:

1. A fuel injector for an internal combustion engine comprising:

a nozzle body having a spray tip through which fuel can be selectively emitted through at least one spray orifice;

a needle slideably arranged in said nozzle body in order to control said at least one spray orifice through its displacement;

a control chamber associated with said needle, which, in use, is filled with high-pressure fuel in order to exert, at least indirectly, a pressure force on said needle in its closing direction, wherein said control chamber is in communication with a high pressure fuel channel through an inlet restrictor and wherein the pressure in said control chamber can be reduced by allowing fuel to flow out of said control chamber through an outlet restrictor;

a control valve operated by an actuator and associated with said control chamber to allow or hinder the flow of fuel out of said control chamber through said outlet restrictor;

wherein said inlet restrictor and said outlet restrictor have respective geometries that are designed so that the ratio of outlet fuel flow rate over inlet fuel flow rate increases at low fuel temperatures, as compared to normal fuel temperatures at same fuel pressure, in order to cause a greater pressure reduction in said control chamber.

2. The fuel injector according to claim 1, wherein the ratio of outlet fuel flow rate over inlet fuel flow rate increases at low fuel temperatures by about 5% to 25%.

3. The fuel injector according to claim 1, wherein said inlet restrictor is a machined hole.

4. The fuel injector according to claim 1, wherein said inlet restrictor is located in an inlet fuel channel opening in said control chamber; and said inlet restrictor is defined by an axial groove in an outer surface of a plug element fitted in said inlet fuel channel.

5. The fuel injector according to claim 1, wherein said needle extends in said control chamber and is biased into its closing direction by a spring means which is arranged in said control chamber.

6. The fuel injector according to claim 1, wherein in said nozzle body, a front region of said needle is subject to a pressure of fuel supplied from said high pressure fuel channel through a nozzle orifice restrictor.

7. The fuel injector according to claim 1, wherein an outlet channel connects the control chamber, through said outlet restrictor, to said control valve and wherein, when said control valve is open, said outlet channel communicates with a low pressure drain.

8. A fuel injection system for an internal combustion engine comprising one more fuel injectors as claimed in claim 1.

9. A fuel injector for an internal combustion engine comprising:

a nozzle body having a spray tip through which fuel can be selectively emitted through at least one spray orifice;

a needle slideably arranged in said nozzle body in order to control said at least one spray orifice through its displacement;

a control chamber associated with said needle, which, in use, is filled with high-pressure fuel in order to exert, at least indirectly, a pressure force on said needle in its closing direction, wherein said control chamber is in communication with a high pressure fuel channel through an inlet restrictor and wherein the pressure in said control chamber can be reduced by allowing fuel to flow out of said control chamber through an outlet restrictor, and a control valve operated by an actuator and associated with said control chamber to allow or hinder the flow of fuel out of said control chamber through said outlet restrictor;

wherein said inlet restrictor and said outlet restrictor have respective geometries that are designed so that the ratio of outlet fuel flow rate over inlet fuel flow rate increases at low fuel temperatures, as compared to normal fuel temperatures at same fuel pressure, in order to cause a greater pressure reduction in said control chamber; and wherein the inlet restrictor and the outlet restrictor are such as to exhibit a dimensional ratio $R_{dim}$ defined as $$R_{dim}=(L_{SPO}/D_{SPO})/(L_{INO}/D_{INO}),$$

which is not more than 0.75, where $L_{SPO}$ and $D_{SPO}$ are the respective length and diameter of the outlet restrictor, and $L_{INO}$ and $D_{INO}$ are the respective length and diameter of the inlet restrictor.

10. The fuel injector according to claim 9, wherein $R_{dim}$ is in the range $0.1 \leq R_{dim} \leq 0.70$.

11. The fuel injector according to claim 9, wherein $R_{dim}$ is in the range $0.1 \leq R_{dim} \leq 0.50$.

12. The fuel injector according to claim 9, wherein $R_{dim}$ is in the range $0.2 \leq R_{dim} \leq 0.40$.

13. The fuel injector according to claim 9 wherein the inlet restrictor and outlet restrictor are such that a length ratio $R_L=L_{SPO}/L_{INO}$ is in the range $0.2 \leq R_L \leq 0.8$.

14. The fuel injector according to claim 9, wherein the diameter of said inlet restrictor and the diameter of said outlet restrictor are defined to achieve a predetermined flow ratio at normal operating temperatures.

15. The fuel injector according claim 9, wherein the inlet restrictor and the outlet restrictor are such that their diameter ratio $R_D$ is in the range $0.8 \leq R_D \leq 1.2$.

16. The fuel injector according claim 9, wherein the inlet restrictor and the outlet restrictor are such that their diameter ratio $R_D$ is in the range $0.9 \leq R_D \leq 1.1$.

17. The fuel injector according to claim 9, wherein the ratio of outlet fuel flow rate over inlet fuel flow rate increases at low fuel temperatures by about 5% to 25%.

18. The fuel injector according to claim 9, wherein said inlet restrictor is located in an inlet fuel channel opening in said control chamber; and said inlet restrictor is defined by an axial groove in an outer surface of a plug element fitted in said inlet fuel channel.

19. The fuel injector according to claim 9, wherein said needle extends in said control chamber and is biased into its closing direction by a spring means which is arranged in said control chamber.

20. The fuel injector according to claim 9, wherein in said nozzle body, a front region of said needle is subject to a pressure of fuel supplied from said high pressure fuel channel through a nozzle orifice restrictor.

* * * * *